US005735320A

United States Patent [19]

Tune et al.

[11] Patent Number: 5,735,320

[45] Date of Patent: Apr. 7, 1998

[54] DISPENSER FOR A TWO-PART COMPOSITION

[75] Inventors: Michael P. Tune, Cordova, Tenn.; W. Lance H. Hemsarth, Ringwood, N.J.

[73] Assignee: The Sherwin-Williams Company, Cleveland, Ohio

[21] Appl. No.: 700,809

[22] Filed: Aug. 21, 1996

[51] Int. Cl.[6] ..... B65D 81/00

[52] U.S. Cl. ..... 141/330; 141/2; 141/9; 141/22; 141/100; 141/319; 141/326; 141/364; 141/381; 222/83; 222/83.5; 222/88; 206/222; 215/6

[58] Field of Search ..... 141/2, 9, 18, 21, 141/22, 100, 319–322, 325, 326, 329, 330, 364, 375, 380, 381; 222/83, 83.5, 88; 206/219, 222; 215/6

[56] References Cited

U.S. PATENT DOCUMENTS

| | | | |
|---|---|---|---|
| 1,780,728 | 11/1930 | Webber | 215/6 |
| 2,684,167 | 7/1954 | Bruns | 215/6 |
| 2,719,628 | 10/1955 | Ivanoff | 141/364 X |
| 2,762,527 | 9/1956 | Manley | 141/364 X |
| 3,045,723 | 7/1962 | Gainor | 141/381 |
| 3,797,646 | 3/1974 | Horne | 206/219 |
| 4,458,733 | 7/1984 | Lyons | 141/326 X |
| 4,467,588 | 8/1984 | Carveth | 206/219 X |
| 4,776,972 | 10/1988 | Barrett | 206/219 X |
| 4,899,789 | 2/1990 | Carow | 141/319 X |
| 4,936,841 | 6/1990 | Aoki et al. | 206/222 X |
| 5,170,888 | 12/1992 | Goncalves | 206/222 |
| 5,186,323 | 2/1993 | Pfleger | 222/83 X |
| 5,257,650 | 11/1993 | Fisk et al. | 141/9 |
| 5,402,920 | 4/1995 | Dhillon | 141/364 X |
| 5,405,051 | 4/1995 | Miskell | 222/88 X |

*Primary Examiner*—J. Casimer Jacyna
*Attorney, Agent, or Firm*—Vivien Y. Tsang; Robert E. McDonald; Heidi A. Boehlefeld

[57] ABSTRACT

A dispenser is provided for separately storing and facilitating the mixture of separate components of a two-part composition. The dispenser includes a first container having a chamber for retaining one of the components and a second container having a chamber for retaining the other of the components and for mixing the components together to form the resultant two-part composition. A receptacle sleeve is provided and is mounted on the second container. The receptacle sleeve is adapted to secure the two containers together during periods of storage and transportation as well as to facilitate mixture of the components. The receptacle sleeve further serves to protect the user from exposure to the unmixed components as well as providing a drip-free spout in dispensing the composition. A method is further provided for alternately storing the separate components and admixing them together in one of the containers.

6 Claims, 2 Drawing Sheets

DISPENSER FOR A TWO-PART COMPOSITION

BACKGROUND OF THE INVENTION

1. Field of the Invention

The present invention relates generally to a dispenser for a two-part composition and, more particularly, to such a dispenser that is adapted to separately store and mix together the components of a two-part composition. The dispenser of the present invention includes separate, interlocking containers for separately storing the individual components and means for facilitating the mixture thereof prior to use of the composition. Means are provided for protecting the user from contact with the unmixed components. A method is further provided for storing the individual components and facilitating their mixture to form the composition.

2. Description of the Prior Art

There are many commercially available chemical products on the market with two separately packaged components that must be mixed together prior to use or application. For example, certain floor finishing products are provided with a separate cross-linking agent that must be added to and mixed with the product immediately prior to use to chemically activate such finishing product. Since such cross-linking agents are not typically compatible with the finishing product, they must be maintained separately from the finishing product prior to final mixture and use. A further complicating problem is that many cross-linking agents are toxic in an undiluted condition and, as such, precautions must be taken to avoid contact with the skin during the mixing process.

Epoxy products are another type of commercial product where the component parts thereof, i.e., the resin and catalyst or hardener, are sold separately with the user being instructed to mix them together prior to use.

To facilitate the storage and mixture of such products, certain twin-container dispensers have heretofore been provided. Examples of such two vessel containers are described, for example, in U.S. Pat. No. 1,007,679 which issued to C. Ellis et al. on Nov. 7, 1911 for Multicontainer Bottle; U.S. Pat. No. 4,614,437 which issued on Sep. 30, 1986 to J. D. Buehler for Mixing Container and Adapter; U.S. Pat. No. 4,779,991 which issued on Oct. 25, 1988 to M. Kitamura et al. for Bottle For Mixing and Method for Mixing With the Said Bottle; U.S. Pat. No. 4,801,009 which issued on Jan. 31, 1989 to W. Amos for Two Compartment Container for Mixing; U.S. Pat. No. 5,152,965 which issued on Oct. 6, 1992 to R. Fisk et al. for Two-Piece Reagent Container Assembly; U.S. Pat. No. 5,186,323 which issued on Feb. 16, 1993 to F. W. Pfleger for Dual Compartment Mixing Container; and U.S. Pat. No. 5,209,565 which issued on May 11, 1993 to A. Goncalves for Assembly Adapted for the Mixing of Two Different Products Stored Separately.

Other patents which disclose similar devices include, for example, U.S. Pat. No. 2,580,836 which issued on Jan. 1, 1952 to R. R. Rausch for Intravenous Solution Technique and Apparatus; U.S. Pat. No. 3,537,610 which issued on Nov. 3, 1970 to M. Bilon for Device for Closing a Box; U.S. Pat. No. 4,146,153 which issued on Mar. 27, 1979 to W. J. Bailen for Sterile Dispensing Device; U.S. Pat. No. 5,061,264 which issued on Oct. 29, 1991 for Apparatus for Contacting Material Such as a Drug with a Fluid; U.S. Pat. No. 5,114,011 which issued on May 19, 1992 to E. S. Robbins III for Container Assemblies with Additive Cups; and U.S. Pat. No. 5,469,980 which issued on Nov. 28, 1995 to J. R. O'Meara et al. for Child Resistant Container Closure Assembly.

While many of these patents disclose dispensers having separate containers or chambers, none are able to achieve the specific objective of the present invention, namely to provide a dispenser that is able to separately store the individual components of a two-part composition and then facilitate the mixture of such components while protecting the user from contact with the unmixed components.

As will be appreciated, none of these prior patents even address the problem faced by applicant let alone offer the solutions proposed herein.

SUMMARY OF THE INVENTION

Against the foregoing background, it is a primary object of the present invention to provide a dispenser which permits the separate storage of the components of a two-part composition.

It is another object of the present invention to provide such a dispenser which facilitates mixture of such components prior to use of the composition.

It is still another object of the present invention to provide such a dispenser where the user is protected from contact with the unmixed components during mixture thereof.

It is yet another object of the present invention to provide such a dispenser which includes separate containers for storing the components prior to mixture.

It is yet still another object of the present invention to provide such a dispenser in which the components are stored in pre-measured quantities.

It is another object of the present invention to provide a method for separately storing the components of a two-part composition and facilitating the mixture of such components immediately prior to use of the composition.

To the accomplishments of the foregoing objects and advantages, the present invention, in brief summary, comprises a dispenser for separately storing and facilitating the mixture of separate components of a two-part composition. The dispenser includes a first container having a vessel portion for retaining one of the components and a second container having a vessel portion for retaining the other of the components and for mixing the components together to form the resultant two-part composition. A receptacle sleeve is mounted on the second container and is adapted to receive and secure the first container during periods of storage and transportation. Upon inversion of the first container within the receptacle sleeve, the component contained within the first container may be introduced into and mixed with the component in the second container. The receptacle sleeve protects the user and prevents contact with the unmixed components and the resultant composition. The receptacle sleeve further serves as a drip-free spout in dispensing the composition. A method is further provided for storing the individual components and facilitating their mixture to form the composition.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
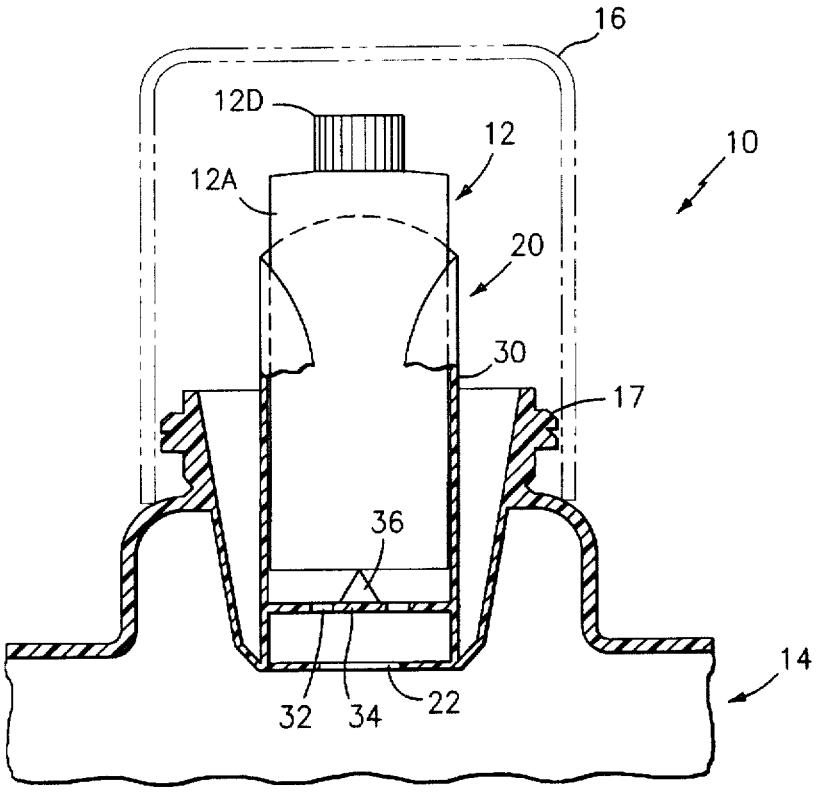
FIG. 1 is a partial, cut-away side view of the dispenser of the present invention showing a first container mounted in a storage position relative to a second container.
Figure 2:
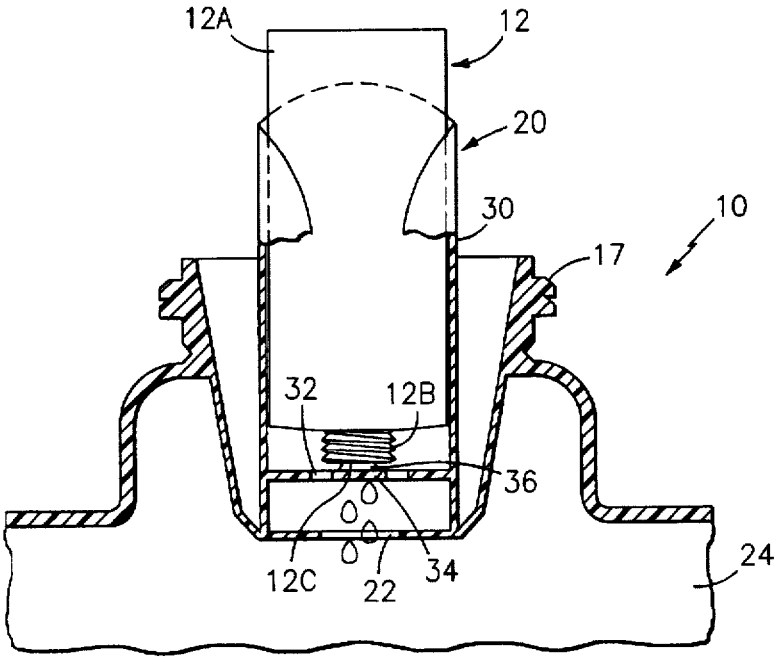
FIG. 2 is a partial, cut-away side view of the dispenser of the present invention showing the first container mounted in a mixing position relative to the second container.

Referring to the drawings and, in particular, to FIGS. 1 and 2 thereof, the dispenser of the present invention, referred to generally by reference numeral 10, includes a first container 12 and a second container 14. The first container 12 is adapted to store one component of a two-component composition. The second container 14 is similarly adapted to store the second component of the two-part composition. The components must be admixed together in the second container 14 prior to actual use of the composition.

The dispenser 10 may be used, for example, with a two-part floor finish composition where a small amount of a cross-linking agent is added to and mixed with the finish composition prior to use. The cross-linking agent may be stored in the first container 12 while the floor finish composition is stored in second container 14.

A measuring cap 16 is provided to protect both the first container 12 and the second container 14 during transportation and storage. Measuring cap 16 further serves to assist the ultimate user in measuring and dispensing the composition after mixture of the two components. Measuring cap 16 may be secured to the second container 14 by a friction fit (as shown) or, alternatively, by threads contained on the measuring cap 16 (not shown) which are adapted to threadably engage complimentary threads 17 on the second container 14. The measuring cap 16 may be formed from a clear, translucent or opaque plastic material.

First container 12 includes a chamber 12A, an outwardly extending, threaded neck 12B, an opening 12C communicating with the chamber 12A, and a cap 12D. Cap 12D is internally threaded and adapted to threadably engage threaded neck 12B to enclose the chamber 12A. The chamber 12A of the first container 12 is further sealed by induction sealing a membrane or seal (not shown) over the opening 12C after filling of chamber 12A.

The second container 14 also includes a chamber 24 and an opening 22 communicating with the chamber 24. A receptacle sleeve 20 is provided adjacent to the opening 22 and contains an outerwall 30 adapted to surround and support the first container 12. The receptacle sleeve 20 further includes a base portion 32 having a center aperture 34 and an upwardly extending piercing element 36 positioned adjacent to the center aperture 34. The outer wall of the receptacle sleeve extends below the base portion 32 thereby raising the base portion 32 above the opening 22 of the second container 14. The receptacle sleeve 20 is further formed so as to act as a drip-free spout in dispensing the composition.

FIG. 1 illustrates the two containers 12, 14 in a transportation and storage position, e.g., after filling of the containers but prior to mixture and use. In this position, the first container 12 with the cap 12D positioned in an upward direction is safely and securely contained within receptacle sleeve 20. The measuring cover 16 is used to totally enclose the first container 12 within the receptacle sleeve 20. The base of the first container 12 is formed from a reinforced plastic material to prevent penetration by the piercing element 36, which serves to support the first container 12 therein.

FIG. 2 illustrates the manner in which the first container 12 is inverted to effect mixing of the components in the second container 14. This is accomplished by first removing the measuring cover 16 in order to provide access to the first container 12 which is stored within the receptacle sleeve 20. The first container 12 is withdrawn from the receptacle sleeve 20 and the cap 12D is removed. The first container 12 is then inverted in orientation with the threaded neck 12B now facing toward the base of the receptacle sleeve 20. The first container 12 is then manually and forcibly re-inserted into the receptacle sleeve 20. The component contained within the first container 12 remains intact within the chamber 12A due to the membrane seal over the opening 12C.

Upon inversion and re-insertion of the first container 12 within the receptacle sleeve 20, the piercing element 36 pierces the membrane that seals the opening 12C and permits the component contained therein to flow through the aperture 34 provided in the base 32 of the receptacle sleeve 20. The component then passes by gravity into the chamber 24 of the second container 14 through the aperture 22 so as to facilitate mixture of the two components in the second container 14.

It will be appreciated that the advantage offered by the subject configuration is that the two components are provided in pre-measured quantities and it is also possible to mix together such unmixed components without any possible exposure to the user.

Figure 3:
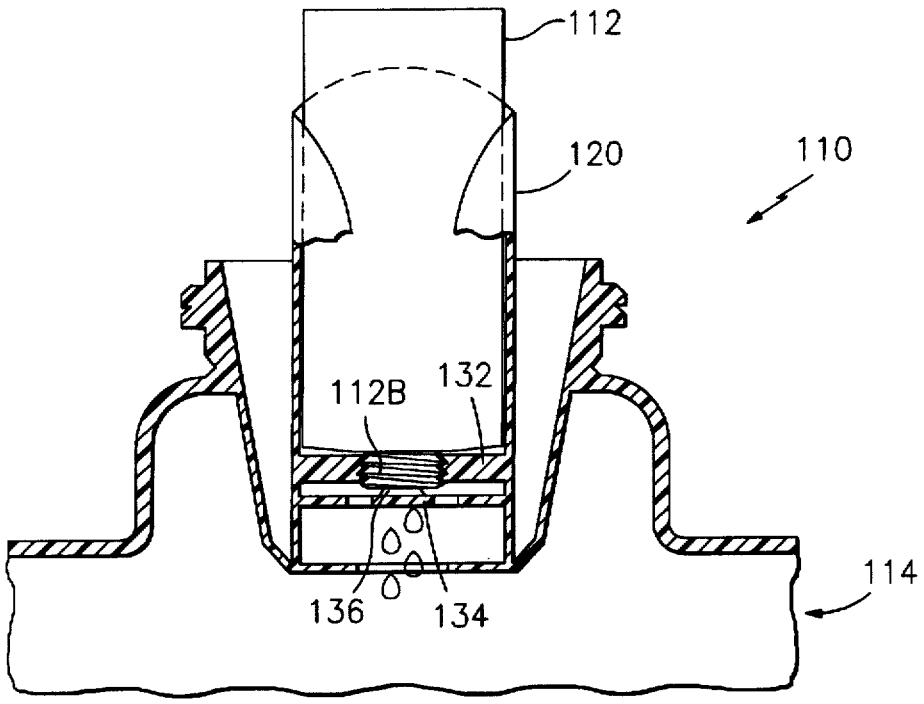
FIG. 3 is a partial cut-away side view of an alternate embodiment of the dispenser of the present invention showing the first container mounted in a mixing position relative to the second container.

FIG. 3 illustrates an alternative embodiment of the dispenser of the present invention in which an alternative securing method is employed between the first and second containers, 112 and 114 respectively, during mixture. The first and second containers 112 and 114, respectively, are virtually identical in shape and size to the containers in FIGS. 1–2. The receptacle sleeve 120 of the second container 114, however, includes a threaded aperture 134 at the base 132 thereof which is adapted to receive and threadably engage the threaded neck 112B of the first container 112.

Rather than manually inserting the first container 112 into the receptacle sleeve 120 of the second container 114, the first container 112 is threadably secured to the second container by engagement of the threaded neck 112B of the first container 112 with threaded aperture 134 of the base 132. This serves to more securely engage the first container 112 with the second container 114 during the mixing process. Thus, when the first container 112 is inverted and reinserted into the receptacle sleeve 120 and threadably engaged with the second container 114 to effect mixing of the components, the membrane that seals the opening to the first container 112 is pierced by piercing element 134.

Having thus described the invention with particular reference to the preferred forms thereof, it will be obvious that various changes and modifications can be made therein without departing from the spirit and scope of the present invention as defined by the appended claims.

Wherefore, we claim:

1. A dispenser for separately storing and facilitating the mixture of separate components of a two-part composition, said dispenser including:

a first container having a chamber for retaining one of said components;

a second container having a chamber for retaining the other of said components and for mixing said components together to form said composition;

a receptacle sleeve mounted on said second container and adapted to secure the two containers together during periods of storage and transportation, said receptacle sleeve includes a base having an aperture passing therethrough and an upwardly extending piercing element positioned adjacent to said aperture; and, said first container has an upper portion and a lower portion, said upper portion having an opening communicating with said chamber and a penetrable seal covering said opening during periods of storage and transportation;

wherein said first container is adapted to be secured within said receptacle sleeve with said lower portion in contact with said piercing element and, upon removal and inversion of its orientation, is further adapted to be reinserted into said receptacle sleeve to dispense the contents of the first container into said chamber of the second container to permit mixture of the components while protecting the user from direct contact with the unmixed components; and wherein said dispenser further includes a detachable measuring cap for enclosing said first container during periods of storage and transportation.

2. The dispenser of claim 1, wherein said first container is adapted to be forced downwardly within said receptacle sleeve upon reinsertion for dispensing of its contents such that said piercing element within said receptacle sleeve is able to pierce said penetrable seal over said opening to its chamber to allow its contents to drain into said chamber of said second container to facilitate mixing of the components.

3. The dispenser of claim 2, wherein said first container is, upon reinsertion, adapted to threadably engage the base of said receptacle sleeve.

4. A method for separately storing the components of a two-part composition and facilitating the admixture of said components in a dispensing container; comprising the steps of:

filling a first container with one of said components through an opening in said first container;

sealing said component within said first container with a penetrable seal covering said opening in said first container;

filling a second container with the other of said components through an opening in said second container;

securing said first container together with the second container by receptacle means mounted on said second container and adapted to secure the two containers together during periods of storage while shielding the user from contact with the unmixed components wherein a releasable measuring cap included in said second container covers said first container during periods of storage and transportation;

introducing said component in said first container with said other component in said second container for admixture therein by piercing the penetrable seal over said opening in said first container with a piercing element positioned at the opening of said second container, allowing said component in said first container to drain into said second container.

5. The method of claim 4, wherein said first container is mounted within said receptacle during periods of storage and transportation.

6. The method of claim 5, wherein said first container threadably engages the base of the receptacle while said component in said first container drains into said second container.

* * * * *